United States Patent [19]

Říha et al.

[11] 4,079,759

[45] Mar. 21, 1978

[54] APPARATUS FOR MEASURING AND ADJUSTING THE LENGTH OF A CONTINUOUSLY DELIVERED WEFT THREAD

[75] Inventors: Miroslav Říha; Jiří Cernocky; Josef Martiňec, all of Vsetin, Czechoslovakia

[73] Assignee: Zbrojovka Vsetin, narodni podnik, Vsetin, Czechoslovakia

[21] Appl. No.: 687,608

[22] Filed: May 18, 1976

Related U.S. Application Data

[63] Continuation of Ser. No. 497,188, Aug. 14, 1974, abandoned, which is a continuation-in-part of Ser. No. 304,060, Nov. 6, 1972, abandoned.

[51] Int. Cl.[2] ..... D03D 47/34

[52] U.S. Cl. ..... 139/452

[58] Field of Search ..... 139/450, 452; 66/139; 226/184; 242/47

[56] References Cited

U.S. PATENT DOCUMENTS

| | | | |
|---|---|---|---|
| 3,276,484 | 10/1966 | Bucher | 139/452 |
| 3,370,618 | 2/1968 | Svaty et al. | 139/452 |

OTHER PUBLICATIONS

The Way Things Work, vol. Two, Simon and Schuster, N.Y., N.Y., pp. 180–183.

*Primary Examiner*—Henry S. Jaudon

[57] ABSTRACT

The required length of a continuously delivered weft thread which is to be introduced into the shed of a weaving loom is measured on the circumference of a cylindrical measuring drum. The angular speed of the measuring drum can be infinitely varied to produce an actually required length of the weft thread, thus permitting an exact adjustment of this length.

4 Claims, 4 Drawing Figures

APPARATUS FOR MEASURING AND ADJUSTING THE LENGTH OF A CONTINUOUSLY DELIVERED WEFT THREAD

This is a continuation of application Ser. No. 497,188 filed Aug. 14, 1974, which itself is a continuation-in-part of application Ser. No. 304,060, filed Nov. 6, 1972, and both now abandoned.

BACKGROUND OF THE INVENTION

This invention relates to a method of and an apparatus for measuring and adjusting the length of a weft thread continuously delivered from a stable weft thread idler shaft. The invention is particularly suitable for shuttleless weaving looms wherein a prior exactly measured length of a weft thread is introduced into the shed as it is, as for instance in the case of jet looms.

Known methods for measuring the length of the weft thread can be substantially divided into two categories: (1) a measuring with discontinuous delivery of the weft thread, and (2) a measuring with a continuous delivery of the weft thread supplied from a stable weft thread idler shaft.

(1) Measuring with a discontinuous delivery of the weft thread is substantially performed by supplying the weft thread from a stable idler shaft, seizing it at a given moment by a rotating lug in order to wind it with the required length on a measuring drum, subsequently removing it by the picking mechanism of the loom, and introducing it into the shed. The weft thread remains thereafter at rest up to its next seizing by the lug. An advantage of this method is that the length of the weft thread can be adjusted within a substantially large range by changing the moment of seizing and thus the length of the weft thread wound on to the measuring drum can also be changed. A drawback, however, is that in case of an intermittent removal the weft thread is subject to substantial stress due to inertia caused by its repeated stopping and being seized in the course of measuring. The time required for measuring is thus limited; this also influences any further increase of the speed and also the efficiency of production of the loom.

(2) In case of the other method, that of measuring the weft thread with continuous delivery, the weft thread, during the course of the whole operating cycle of the weaving loom is taken off uniformly and at a practically constant speed from a stable weft thread idler shaft. This apparatus, for measuring a continuously delivered weft thread, is substantially composed of a measuring drum, the circumference of which corresponds to the required length of the weft thread. The weft thread, in order to secure a correct removal, is pressed against the circumference of the measuring drum by a pressure roller. At a given moment, the prior measured length of the weft thread is removed by the picking device and is introduced into the shed.

There are also measuring devices with continuous delivery of the weft thread having a measuring drum of reduced size upon which a number of turns of the weft thread are wound.

The weft thread is less stressed in measuring devices with a continuous delivery and they are therefore also more advantageous for high speed weaving looms. Their drawback, however, is that if changes of the length of the weft thread are required, a measuring drum with a variable diameter or a set of exchangeable measuring drums has to be used. However; this is costly and wearisome to operate.

SUMMARY OF THE INVENTION

It is an object of this invention to provide a method of and an apparatus for continuous delivery of a weft thread, which enables the length of the weft thread to be adjusted easily and by simple means.

According to this invention the length of the weft thread wound on a constant diameter measuring drum is adjusted to need by adjusting of the angular speed of the measuring drum. This adjustment in angular speed of the drum is accomplished by a device for continuous adjustment of the rotating speed, such device being interposed between the main shaft of the loom and the shaft of the measuring drum. Coaxially with the shaft of the measuring drum there is provided a freely rotatable pressure disc which cooperates with the measuring drum at time intervals which are determined by the working cycle of the loom. In the course of this cooperation, in which the pressure disc is controlled by way of a two-armed lever from a cam fixed on the main shaft, the weft thread is seized between conical surfaces on the circumferences of the measuring drum and the pressure disc, respectively, and the required length of the weft thread is wound onto the cylindrical circumferential surface of the measuring drum. The weft thread is guided from the measuring drum through a central hollow space in the axis of the pressure disc to the picking device; at a given moment, the weft thread is removed from the circumference of the measuring drum and is introduced into the shed. At a following moment, the weft thread is again seized between the measuring drum at the pressure disc, stretched adequately, woven in, and cut. In the meantime, a new length of the weft thread is wound onto the circumference of the measuring drum for the subsequent picking, after which the working cycle is repeated.

The method of and apparatus for measuring the length of the continuously delivered weft thread according to this invention enables the easy and precise changing and maintenance of the length of the weft thread, whereby waste of the weft is reduced in the course of cutting the border of the fabric. The liability of tearing the weft thread is also thereby substantially reduced. The apparatus is simpler to manufacture than other arrangements now used for measuring the length of weft threads.

DESCRIPTION OF THE DRAWINGS

An exemplary embodiment of the object of this invention is shown in the attached drawings, wherein.

DESCRIPTION OF PREFERRED EMBODIMENT

Figure 1:
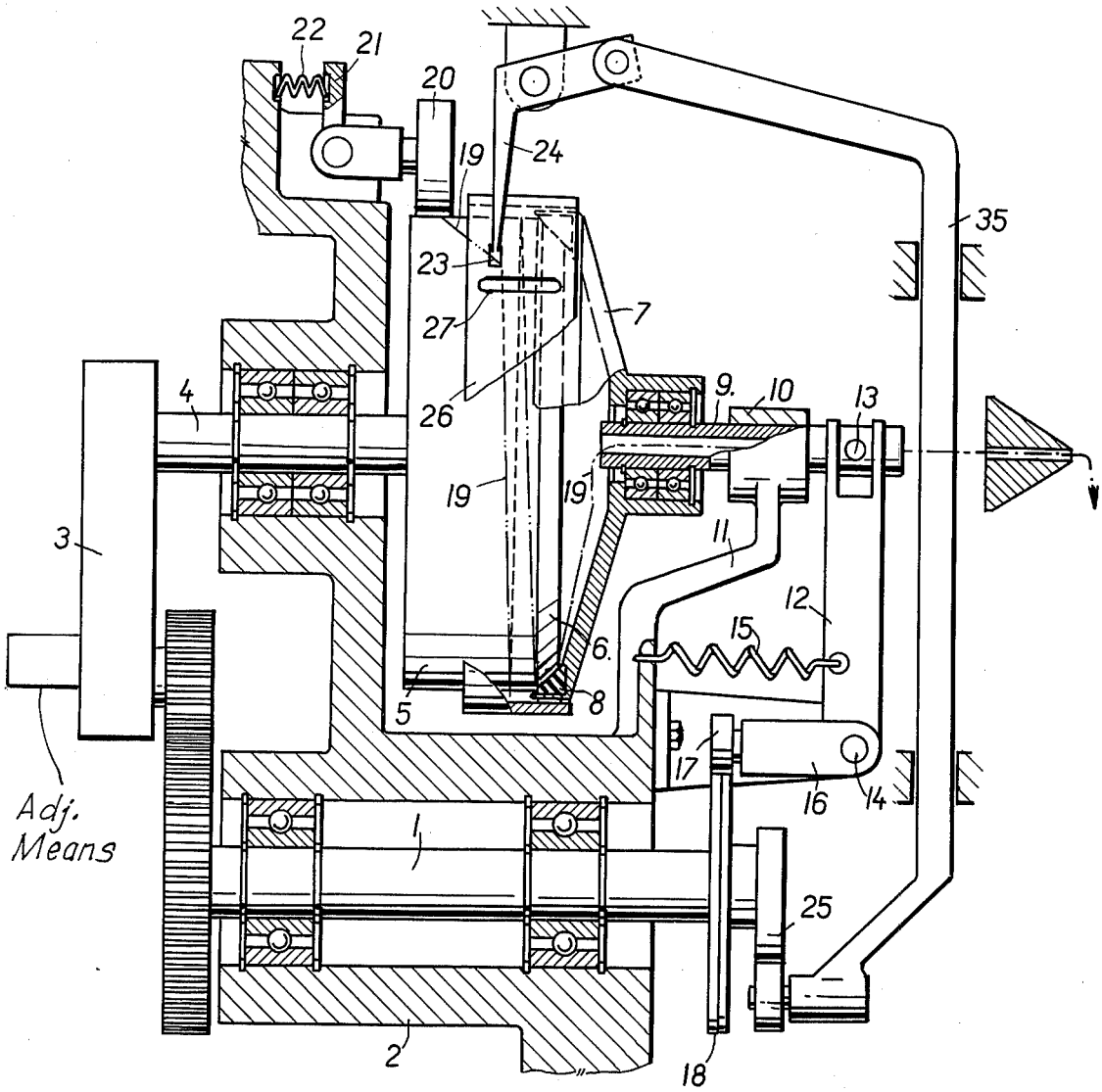
FIG. 1 is an overall view of the arrangement in partial section.

A shaft 4 of a measuring drum 5 is driven from a main shaft 1 of the loom (not shown) shaft 1 being supported by a frame 2 by way of gears and a PIV (position infinitely variable), device 3 for permitting the continuous changing of speed of rotation of the shaft 4. The device 3, which is shown schematically is of a conventional type depicted and described, e.g., in Volume 2 of the publication "The Way Things Work," Simon & Schuster, pp. 182–183 (1971), and permits the selection, e.g., via an adjustment of the separation of one of the illustrated pairs of pulleys, of a speed ratio between shafts 1 and 4 at any desired value within an analog continuum of values between predetermined upper and lower limits. The front part of the measuring drum 5 has a conical surface 6 adapted to cooperate with a similar contact surface of a pressure disc 7, the contact surface being provided with a lining 8 of a resilient material. The pressure disc 7 is rotatably supported on a bushing 9 which is slidably arranged in a sleeve 10 firmly connected by an arm 11 with the frame 2. The position of the bushing 9 is controlled by a fork 12 by way of radial pins 13. The fork 12 is at the end of the upper arm of a two-armed bell crank lever fulcrumed on a pivot pin 14. Such upper arm of the lever is urged by a coil tension spring 15 towards the frame 2. The second arm 16 of the lever bears a roller 17 contacting a control cam 18 affixed to the main shaft 1.

The weft thread 19 is supplied from an idler shaft, not shown in the drawing, under a pressure roller 20, supported by a bell crank lever 21 and urged against the measuring drum 5 by the action of coil compression spring 22 on the vertical arm of lever 21. The weft thread 19 is guided by an eyelet 23 on a lever 23 from the pressure roller 20 through a slot 27 in a cover member 26 for the circumference of the measuring drum 5, where it is deposited by the action of the eyelet 23 on the lever 24 along a helix on measuring drum 5, the position of the lever 24 being controlled from a cam 25 by way of an operating linkage generally designated 35 shown schematically in FIG. 1. The weft thread 19 is subsequently delivered through a central bore 28 of the bushing 9 to the picking device 29, which may be in the form of a fluid jet nozzle. The ballooning of the weft thread due to its removal from the measuring drum 5 in the course of picking is reduced by the cover 26 disposed around the drum.

Figure 2:
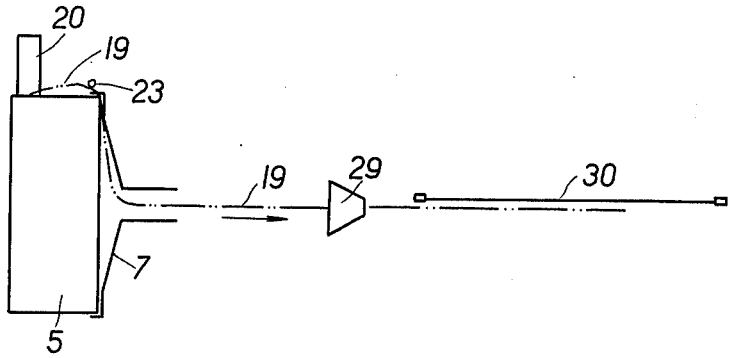
FIGS. 2, 3 and 4 show subsequent operating phase of the measuring arrangement in dependence on the working cycle of the weaving loom.
Figure 3:
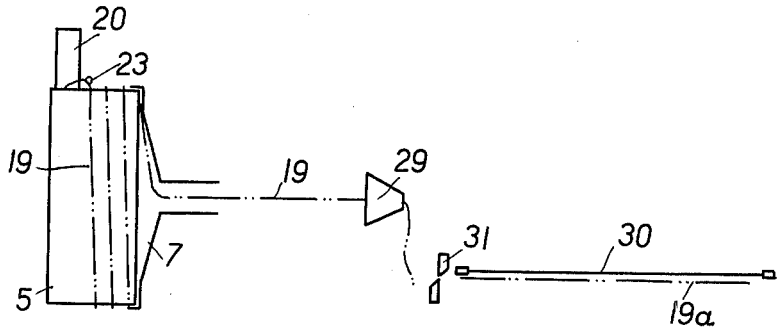
Figure 4:
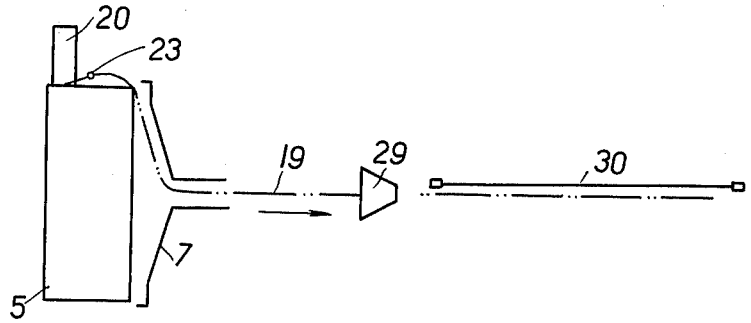

The operation of the arrangement for measuring the length of a continuously delivered weft thread is illustrated in FIGS. 2, 3 and 4, which show different operating phases; in an initial stage (FIG. 2) a position is shown wherein the weft thread 19 is taken off from a stable idler shaft and supplied under the pressure roller 20, which presses it in the course of all operating phases of the measuring arrangement against the circumference of the measuring drum 5.

The measuring arrangement operates as follows:

First phase shown in FIG. 2:

The weft thread 19 is seized between the front part of the measuring drum 5 and the pressure disc 7, the eyelet 23 being in its extreme axially outer (right) position prior to winding on the weft thread 19 on the measuring drum 5. The reed 30 of the loom is in its rear (upper, FIG. 2) position.

Second phase shown in FIG. 3:

The weft thread is still seized between drum 5 and the pressure disc 7, and is deposited by action of the axially inwardly moving eyelet along a helix on the circumference of the measuring drum 5. The reed 30 of the loom in its forward or throw position, and the weft thread 19*a* is woven in and cut off by cutters 31.

Third phase shown in FIG. 4:

The pressure disc 7 is removed from the measuring drum 5, and the weft thread 19, thus released, is taken off from the measuring drum 5 and is introduced by the picking device 29 into the shed of the loom. The reed 30 of the loom is now in its rear position, as shown in FIG. 2.

The invention is illustrated and described with a reference to a preferred embodiment thereof and it is to be understood that is is in no way limited to said preferred embodiment but is capable of numerous modifications according to the appended claims.

What is claimed is:

1. In an apparatus for metering lengths of weft thread for periodic insertion of the thread into a warp shed along a first axis, a drum shaft supported for rotation about the first axis, a drive shaft supported for rotation about a second axis, a rotatable metering drum secured to the drum shaft for rotation therewith and having a periphery around which successive lengths of weft thread may be wound, the periphery including a cylindrical rear section and a frusto-conical front section, means for continuously advancing weft thread to the front section of the measuring drum periphery, clamping means disposed coaxial with and forwardly of the drum and supported for reciprocal movement along the first axis toward and away from the drum, the clamping means having a first surface frictionally engageable with the frusto-conical front section of the drum periphery to secure an intervening portion of the weft thread against the drum periphery when the clamping means is in a rear position, means coupled to the drive shaft for cyclically reciprocating the clamping means between the rear clamping position and a front release position, PIV transmission means coupled between the drum and drive shafts for rotating the drum shaft about the first axis at a speed proportional to the speed of the drive shaft when the drive shaft is rotated about the second axis, means operable when the drum is rotated and when the clamping means is in its rear position for winding a length of the then-clamped weft thread around the drum periphery to be inserted into the warp shed when the clamping means is moved to its front release position, and means for adjusting the speed ratio of the PIV transmission means to a selectable value within an analog continuum of values to correspondingly adjust the length of the weft thread wound on the drum periphery by the winding means.

2. Apparatus as defined in claim 1, in which the rear portion of the frusto-conical front section of the drum is in abutting relation with the front portion of the cylindrical section, said abutting portions having corresponding diameters.

3. Apparatus as defined in claim 1, in which the winding means comprises a thread guide coupled to the drive shaft for axial reciprocation along the length of the drum periphery as the drum is rotated.

4. Apparatus as defined in claim 1, in which the advancing means comprises means for feeding the weft thread to the drum periphery at a constant rate.

* * * * *